US006588244B2

(12) United States Patent
Chevalier

(10) Patent No.: US 6,588,244 B2
(45) Date of Patent: Jul. 8, 2003

(54) PROCESS FOR HYDROFORMING SHEET METAL AND DEVICE FOR PRACTICING THE SAME

(75) Inventor: Lucien Chevalier, La Chappelle Launay (FR)

(73) Assignee: Airbus France, Toulouse Cedex (FR)

( * ) Notice: Subject to any disclaimer, the term of this patent is extended or adjusted under 35 U.S.C. 154(b) by 0 days.

(21) Appl. No.: 09/962,350

(22) Filed: Sep. 26, 2001

(65) Prior Publication Data

US 2002/0035859 A1 Mar. 28, 2002

(30) Foreign Application Priority Data

Sep. 26, 2000 (FR) ..... 00 12208

(51) Int. Cl.[7] ..... B21D 22/20; B21D 26/02
(52) U.S. Cl. ..... 72/57; 72/350; 72/351
(58) Field of Search ..... 72/57, 348, 350, 72/351

(56) References Cited

U.S. PATENT DOCUMENTS 3,344,646 A * 10/1967 Moller ..... 72/348
4,432,222 A * 2/1984 Ujihara et al. ..... 72/350
5,263,354 A * 11/1993 Saunders ..... 72/347
6,308,545 B2 * 10/2001 Burgel et al. ..... 72/57

FOREIGN PATENT DOCUMENTS

FR 2 647 373 11/1990
FR 2 723 867 3/1996

* cited by examiner

*Primary Examiner*—David Jones
(74) *Attorney, Agent, or Firm*—Young & Thompson

(57) ABSTRACT

A process for hydroforming sheet metal, in which a blank (1) is secured with the help of a blank holder (2', 2", 2'") on a matrix (4') provided with a cavity (3') for stamping the blank (1) with the help of a die (5', 5", 5'") entering the matrix, characterized in that during the stamping phase, the play between the die (5', 5", 5'") and the blank holder (2', 2", 2'") is confined within a range of values preventing, between the die and matrix, the formation of a fold, as a function of one and/or the other of the following parameters: pressure of fluid in the cavity (3') of the matrix (4'), and position of the die (5', 5", 5'") relative to the matrix.

16 Claims, 4 Drawing Sheets

PROCESS FOR HYDROFORMING SHEET METAL AND DEVICE FOR PRACTICING THE SAME

Figure 1A:
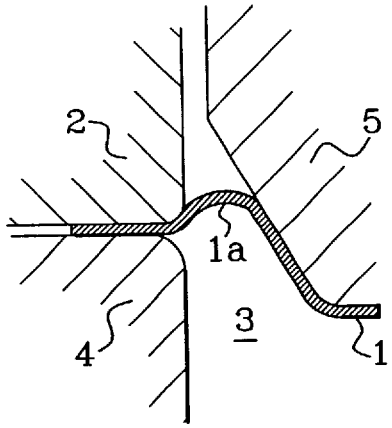

The present invention relates to the production of metallic elements by fluid pressure deformation, or hydroforming, and more particularly to the production, by this technique, of sheet metal.

Hydroforming is a well-known technique which permits, in one of its principal modes of use, deforming a metal sheet held at its periphery between a hollow matrix and a blank holder, by pressing with the help of a die the sheet metal into the cavity of the matrix, a fluid under pressure, such as water, being introduced into the cavity to press the sheet metal against the die.

This forming process permits producing protrusions and complex shapes. Thus, the existence of a high counter-pressure, exerted by the fluid present in the matrix, permits strongly forcing the blank against the die and reproducing faithfully on the latter all the projections and complex shapes.

It moreover permits avoiding localized deformations which give rise to substantial thinning of the initial sheet metal and require the use of substantial local polishing operations. It therefore permits giving the best results from the limit curves of forming. Supplementally, with this process, there is practically no elastic spring back of the material.

Nevertheless, it is seen that, when a blank is formed by the hydroforming process, it tends nevertheless to become thin in the portions which correspond to the angles, to the bends or other changes in direction and for this reason, the elements thus formed have weakened resistance in these portions, which can however be strongly stressed portions in use.

To overcome this drawback, there can be provided reinforcements constituted by pieces of the same nature as the blank, which are cut out to the desired shape and placed in the locations it is desired to reinforce. These pieces can be first welded or disposed in a manner to bond to the blank by diffusion, prior to hydroforming, if this technique is employed. This manner of proceeding is suitable in simple cases, but for complicated pieces, it requires cutting out with precision and securing to suitable locations, a large number of reinforcements. A more precise study of the stresses often requires that the reinforcements have different thicknesses from each other, which complicates the work.

Another solution, proposed by French patent 2 647 373, consists in giving the blank a non-constant thickness such that the piece obtained after forming has at all points the desired thickness. Thus, before its deformation, the portions of the blank which have a greater thickness than the rest of the blank, constitute reserves of material which, during deformation, compensate the thinning of the blank at all portions where it would be observed.

Moreover, in the hydroforming process, the stamping force is substantially greater than the force strictly necessary for the deformation of the material. Thus, the movement of the stamping die supposes a force proportional to the cross-section and to the pressure. The total force to be used is the sum of the stamping force plus the force required to overcome the counter-pressure. The stamping force can become negligible compared to the counter-pressure force. It is thus necessary to use very powerful machines to be able to produce pieces by a hydroforming process.

To solve this problem, there has been proposed by French patent 2 723 867 a hydraulic stamping process for a metallic blank consisting in placing the blank on a matrix having a central chamber to permit stamping by means of a die penetrating the chamber of the matrix and acting on a first surface of the blank and by using the hydraulic counter-pressure provided on the second surface of the blank by a liquid disposed in the matrix chamber. According to this process, the volume in the chamber is constant or nearly constant. The die is fixed relative to a frame and it is the matrix which is movable in translation so that the die penetrates the matrix chamber. In the practice of this process, the bottom of the chamber is constituted by a fixed piston sliding axially in the matrix, this piston being of a cross-section equivalent to that of the die. This permits obtaining a constant volume in the central chamber of the matrix.

However, these various techniques do not eliminate for all that the so-called "sock" effect inherent in the principle of hydroforming.

This effect manifests itself when the play between the die and the blank holders is great. It corresponds to the swallowing of material brought about by the counter-pressure prevailing in the cavity of the matrix. Thus, the counter-pressure prevailing in the cavity being high, the material is pressed back and enters into the space which exists between the blank holders and the die. It thus forms a fold of material that is in danger of being pinched during descent of the die and thus to be weakened. The resulting piece could ultimately break in line with this bend, under force imposed during its normal use.

The present invention seeks precisely to overcome this "sock" effect by providing a hydroforming process avoiding the formation of folds between the blank holder and the die.

To this end, the invention has for its object a sheet metal hydroforming process, in which a blank is secured with the help of a blank holder on a matrix provided with a cavity for stamping said blank with a die entering the matrix, characterized in that during the stamping phase, the play between the die and the blank holder is confined within a range of values preventing between said die and the matrix, the formation of a fold, as a function of one end or the other of the following parameters: pressure of the fluid in the cavity of the matrix and position of the die relative to the matrix.

Preferably, the control of the play between the die and the blank holder is carried out by a modulation of the geometry of the portions facing said die and of said blank holder during stamping, said modulation taking place either during all the duration of stamping, or during an initial phase of said stamping, according to the establishment of a minimum permanent play.

Preferably, only one of the two elements—die and blank holder—is provided with a portion of variable geometry.

The process is applicable to matrices whose cavity is connected or not to a source of fluid, preferably a liquid, for counter-pressure.

The invention also has for its object a device for practicing the above process, comprising a matrix with a cavity adapted to receive a stamping die for a metallic blank fixed on the matrix with the help of a blank holder, characterized in that it comprises means to modify the play between the die and the blank holder in the course of the stamping operation.

Figure 1B:
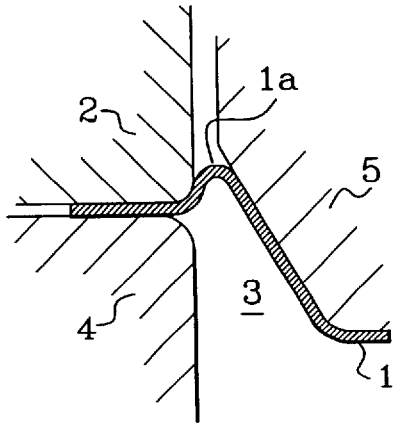
Figure 1C:
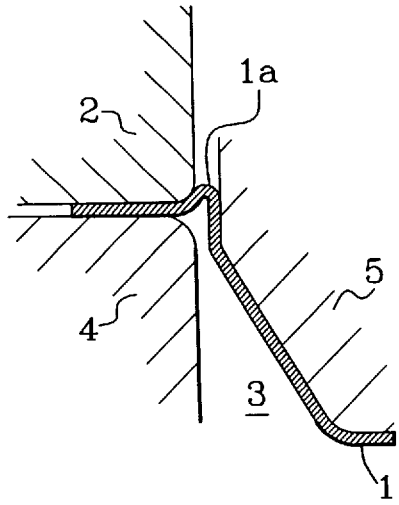
Figure 2:
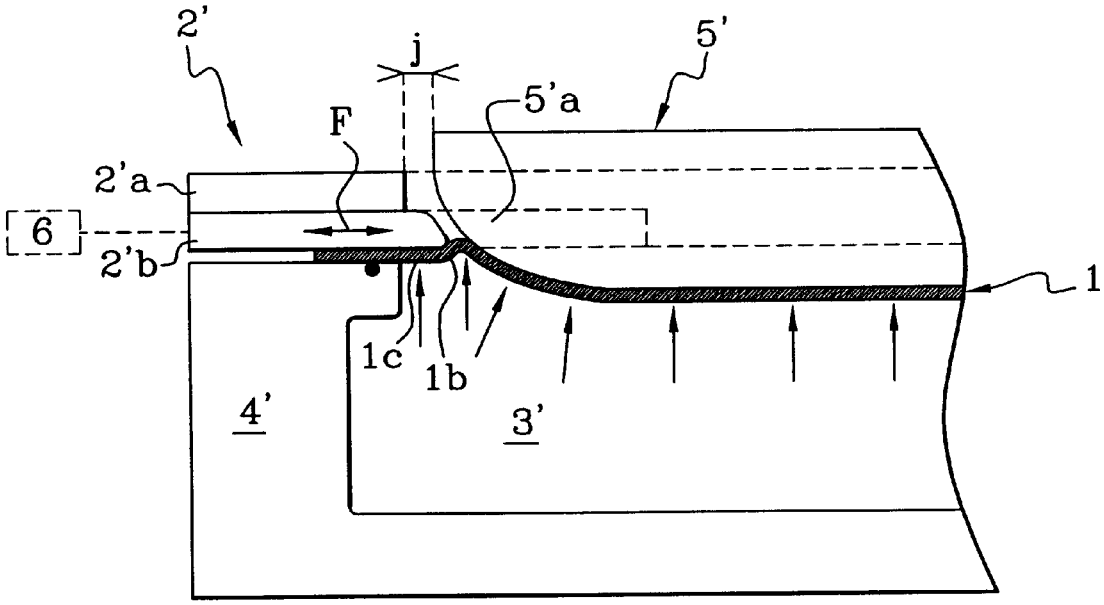
Figure 2:
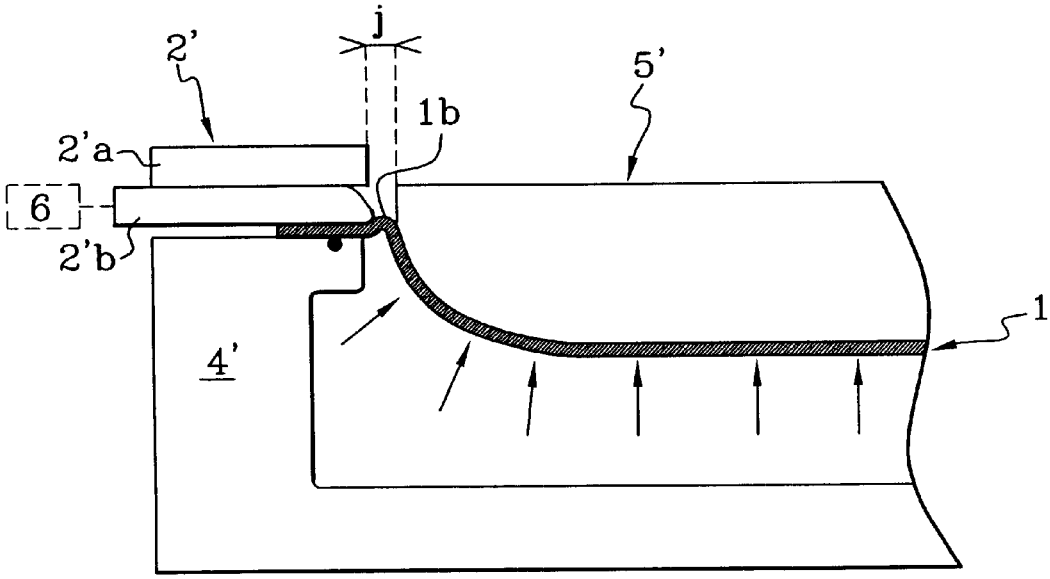
Figure 3:
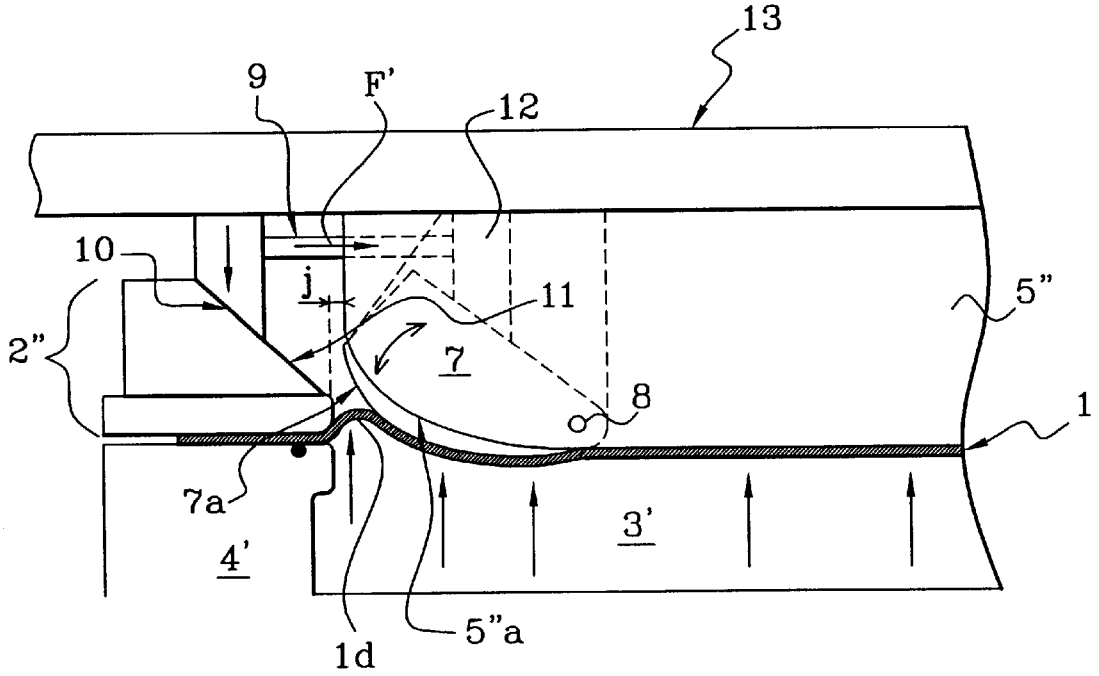
Figure 3:
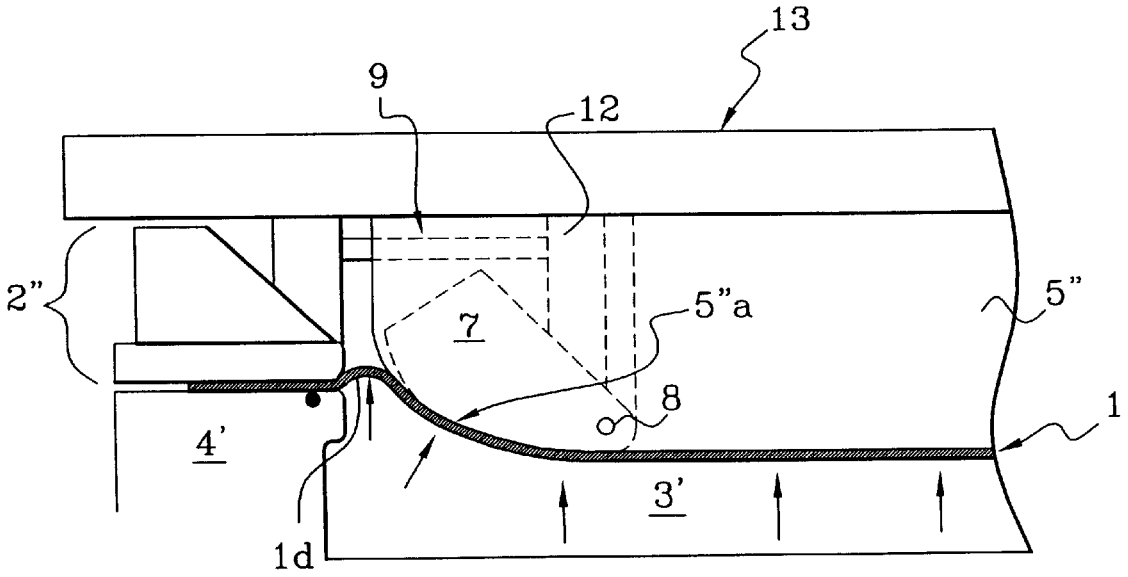
Figure 4:
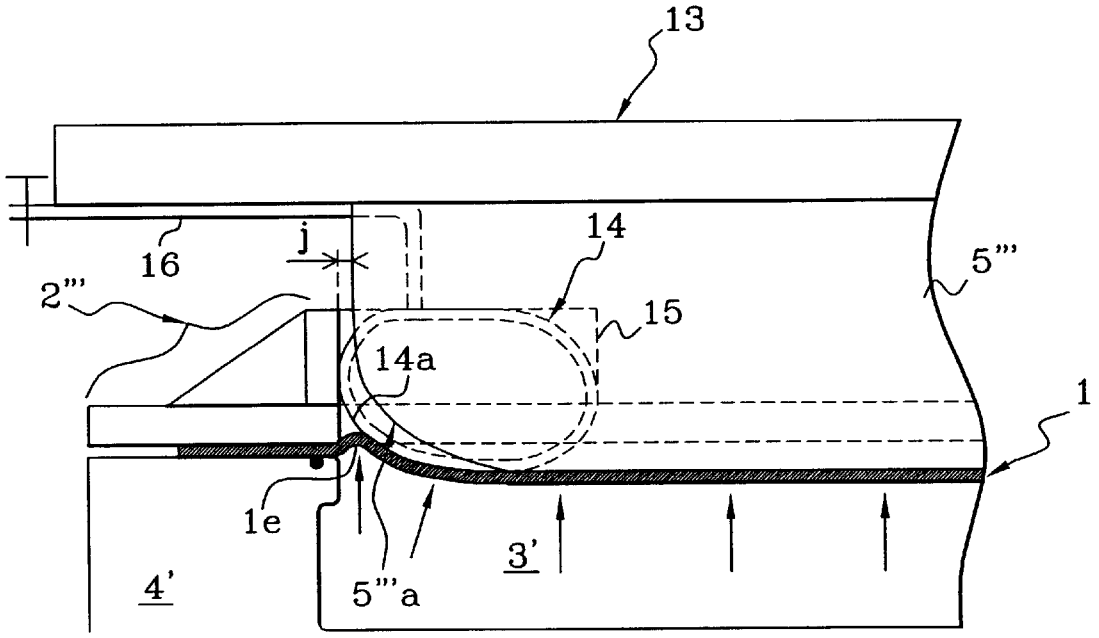
Figure 4:
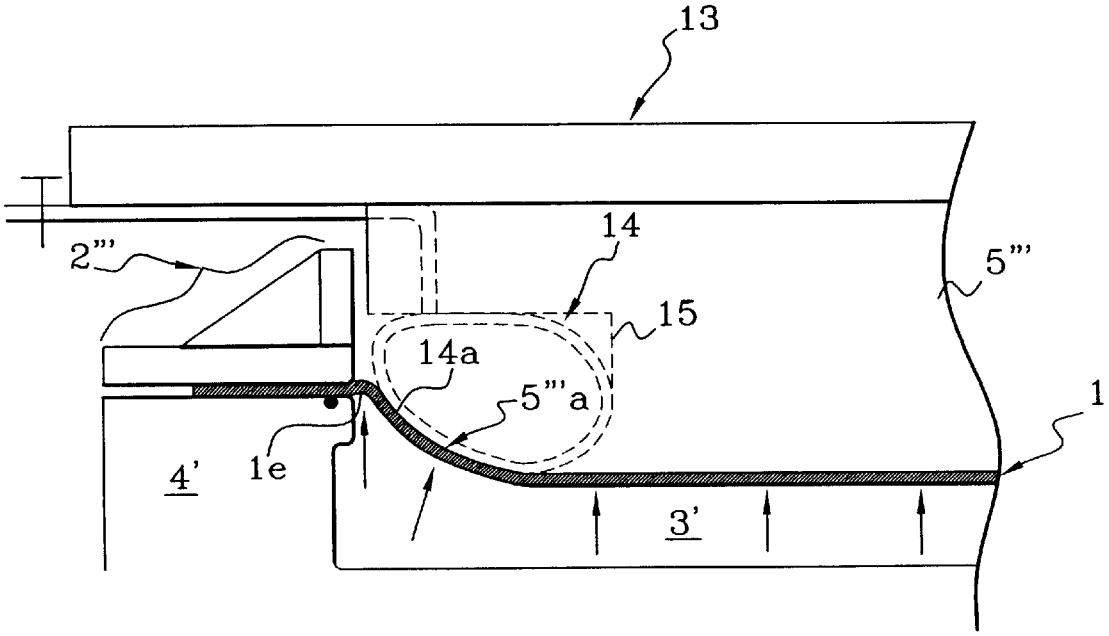

Various embodiments of such a device will now be described in detail with reference to the accompanying drawings, in which:

FIGS. 1*a* to 1*c* are schematic illustrations of the "sock" effect in a conventional hydroforming device;

FIG. 2 shows schematically a first embodiment of a hydroforming device according to the invention;

FIG. 2' shows the device of FIG. 2 at the end of stamping;

FIG. 3 shows schematically a second embodiment;

FIG. 3' shows the device of FIG. 3 at the end of stamping;

FIG. 4 shows schematically a third embodiment, and

FIG. 4' shows the device of FIG. 4 at the end of stamping.

FIGS. 1*a* to 1*c* show the so-called "sock" phenomenon inherent in the process of hydroforming applied to stamping of metal sheets.

The blank 1 to be shaped is gripped peripherally with the help of a blank holder 2 about the periphery of a cavity 3 provided in a matrix 4 and a die 5 is applied to the blank 1.

The pressure of the die 5 conjugated with the counter-pressure prevailing in the cavity 3, itself supplied or not with a fluid under pressure, firmly presses the blank against the front surface of the die in the course of its descent.

At the beginning of stamping (FIG. 1*a*), the portion 1*a* of the blank located between the blank holder 2 and the die 5 is pressed by the counter-pressure prevailing in the cavity 3, thereby producing the beginning of a fold due to an excess of material between the blank holder and the die.

Although the die 5 continues its descent (FIG. 1*b*), the starting fold 1*a* is wedged between the blank holder 2 and the die 5, thereby forming a fold in the material which will, at the end of the descent of the die (FIG. 1*c*), be pinched to the maximum to form a veritable reentrant bend, necessarily weakened, and which is susceptible to break under force imposed during normal use of the piece constituted by the blank thus formed or integrating this latter.

The invention seeks to overcome this drawback by providing a hydroforming process avoiding, at the beginning of stamping, the creation of an excess of material between the blank holder and the die that would lead to the formation of a fold.

To this end, and according to the invention, there will be adapted the play between the blank holder and the die to contain it within a range of values preventing the formation of a fold such as shown at 1*a* in FIGS. 1*a* to 1*c*.

This adaptation is carried out having a count of the morphology of the blank holder and of the blank, of the nature and thickness of the blank, and as function of the counter-pressure exerted on the surface of the blank opposite the die and/or of the position of the die relative to the matrix.

Various means can be used to carry out this adaptation or control of the play between the blank holder and the die, particularly during the initial stamping phase.

FIG. 2 shows a first embodiment of the process according to the invention, according to which the play between the blank holder 2' and the die 5' is modulated by a modification of the geometry of blank holder, particularly as a function of the depth of stamping of the die 5'.

By blank holder 2' is meant a device constituted by one or several pieces associated so as to ensure the strong pressing of the periphery of the blank 1 between the periphery of the cavity 3' and the matrix 4' during stamping.

Given the shape of the head of the die 5', which has a rounded portion 5'a facing the blank holder 2', it is evident that at this beginning of stamping, when the front surface of the die enters into contact with the blank 1, the play between the blank holder 2' and said part 5'a is at a maximum at this time.

So as to reduce the play, and according to the invention, the blank holder 2' will be configured such that it has a variable geometry, by providing said blank holder 2' in the form of an assembly of a fixed portion 2'a and a movable portion 2'b, interposed between the fixed portion 2'a and the blank 1 and adapted to slide in a plane parallel to that of the blank 1.

Said movable portion 2'b is for example constituted by a flat segment, extending over at least a portion of the periphery of the cavity 3' and movable in the direction of the double arrow F, so as to approach or recede from the die 5', over a suitable distance, with the help of means provided for this purpose and symbolized at 6.

Therefore, at the beginning of the stamping phase, and as shown by FIG. 2, the movable portion 2'b of the blank holder 2' is close to the die 5' to form a reduced play between the portion 5'a of the die and the section in question, beveled in correspondence with the mean inclination of said portion 5'a of the movable segment 2'b.

This play is of course changeable as a function of the momentary position of the die 5 relative to the matrix 4' and will be controlled by progressive programmed retraction of the segment 2'b concurrently with the downward pressing of the die 5' into the matrix 4'.

It is to be noted that this play can be kept constant and, for example, equal to the minimum play j between the blank holder 2' and the flank of the die 5', but it can be modified continuously or incrementally, whilst being held within a predetermined range of values.

The approach of the movable blank holder 2'b and of the die 5' substantially constricts the passage between the blank holder and the die and leaves the blank 1 with only a small free space, such that in this space, the blank 1 deforms only with a small undulation 1*b*, the rest 1*c* of the free region of the blank between the matrix 4' and the die 5' being held by the movable blank holder 2'b.

As the downward movement of die 5' continues, the movable portion 2'b will retract, such that at the end of stamping (FIG. 2') there remains between the blank holder and the die only the minimum play j or a more reduced play if the complete retraction of the portion 2'b has not taken place.

The maximum deformation of the blank in the region between the blank holder 2' and the die 5' will thus be a small undulation 1*b* of the type shown in FIG. 2, which is not subject to damage by pinching and rolling between the blank holder and the die as in the case of FIGS. 1*a* to 1*c*.

The sheet metal thus formed will accordingly not have a weakened zone.

The movement of the portion 2'b concomitantly with the descent of the die 5' can be carried out by subjecting the portion 2'b to the movement of the die 5' or simply by mechanical pressing back by the die 5' of the portion 2'b with the help of suitable means.

FIG. 3 shows another embodiment for the practice of the invention, consisting in giving to the portion of the die 5" facing the blank holder 2" a variable geometry, said blank holder 2" being of fixed configuration.

To this end, the die 5" is provided peripherally with a plurality of recesses each receiving a retractable cam 7 articulated about an axis 8 parallel to the plane of the blank 1.

Each cam 7 is retractable to within the die 5" and its external surface 7*a* is shaped to correspond with that of the die such that in the final stamping position, said external surface 7*a* of the cam will be continuous with the face 5"a of the die to give to the blank 1 the predetermined shape.

The position of the cams 7 is determined in correspondence with the position of the die 5" relative to the matrix 4'.

This correspondence can be ensured as shown by mechanical pressing back of the cam 7 progressively with the descent of the die 5", by means of a return slide 9 having a surface 10 inclined at 45° and coacting with a corresponding inclined surface 11 provided on the blank holder 2" and an arm 12 for controlling rotation of the cam 7, via a gear system (not shown).

The die 5" and the return slide 9 are pressed simultaneously against the blank 1 and the blank holder 2" by the upper plate 13 of the press.

At the beginning of stamping, as shown by FIG. 3, the cam 7 projects the most, so as to reduce the play between the die and the blank holder, which play is, as indicated above relative to FIG. 2, a maximum at this point in the operation.

The surface 10 of the slide is thus in the upper portion of the fixed surface 11.

Such a reduced play brakes the flow of material between the die and the blank holder such that it forms at this position only a small undulation id which will be contained by the cam 7 all along the displacement of the die 5" within limits so as not to create local decreases in the mechanical properties of the sheet metal thus shaped.

In the course of this movement, the slide 9 will move in the direction of the die 5", as indicated by the arrow F' and will cause, by the arm 12, the rotation of the cam 7 in the direction of its retraction within the die.

This play between the blank holder 2" and the die 5" can thus be contained within a predetermined range of values, the play at the end of the path of the die being able to be the minimum play j between the blank holder 2" and the die 5".

FIG. 3' shows the device of FIG. 3 at the end of stamping.

As a modification, the cam 7 could, by sliding on the side facing the blank holder 2", raise progressively as the die descends.

According to this modification, the cam 7 comprises a prolongation in the direction of the blank holder 2" forming a finger coacting with the surface of the blank holder forming a cam.

FIG. 4 shows still another embodiment of the process of the invention, consisting in modifying the geometry of the portion of the die 5'" facing the blank holder 2'" with the help of an inflatable bladder 14 disposed within the die about its periphery, in a suitable annular recess 15.

The bladder 14 is connected by a passageway 16 to a source of fluid under pressure, preferably liquid, and is disposed in the recess 15 so as to project from the front surface 5'" a of the die in a controlled manner under pressure of fluid sent to the bladder.

Between the die 5'" and the blank holder 2'" exists the minimum play j, as in the preceding embodiments.

At the beginning of stamping, as before, the play between the die 5'" and the blank holder 2'" at the height of the blank 1 is, as shown by FIG. 4, much greater than the minimum play j. This play is substantially reduced by inflating sufficiently the bladder 14 such that it extends beyond its recess 15 to substitute itself by the projecting portion 14*a* of the die 5'" to press back the blank and to constrict the passage between the blank holder 2'" and the die 5'".

There is thus formed between portion 14*a* of the bladder and the blank holder 2'" only a small undulation 1*e* of small amplitude, in the blank 1, which does not give rise to weakening of the final shaped piece.

During descent of the die 5'", the bladder 14, whose fluid supply pressure is subject to the movement of said die or if desired to the pressure prevailing in the cavity 3', retracts until it is completely withdrawn into its recess 15, its portion 14*a* being flush with the surrounding surface 5'" a of the die.

FIG. 4' shows the device of FIG. 4 at the end of stamping.

Finally, the invention obviously is not limited to the embodiment shown and described above, but on the contrary covers all modifications, particularly as to the means to create a controllable play by spacing between one of the two members comprising the blank holder and the die, by using one of the two as a fixed reference for the play and by configuring the other with a variable geometry controlled, subjected to or connected with particularly the path of the die and/or the pressure prevailing in the cavity of the matrix.

I claim:

1. Process for hydroforming sheet metal, comprising the steps of:

fixing with the help of a blank holder (2', 2", 2'") a blank (1) to a matrix (4') provided with a cavity (3') for stamping said blank (1) with a die (5', 5", 5'") penetrating the matrix; and keeping the play between the die (5', 5", 5'") and the blank holder (2', 2", 2'") within a range of values preventing the formation of a fold between said die and matrix, as a function of fluid pressure in the cavity (3') of the matrix (4') during stamping.

2. Process according to claim 1, wherein the keeping the play between the die (5', 5", 5'") and the blank holder (2', 2", 2'") step is effected by modulation of the geometry of facing portions of said die and blank holder during stamping.

3. Process according to claim 2, wherein said modulation is carried out during an initial stamping phase and is followed by the establishment of a permanent minimum play (j).

4. Process according to claim 2, wherein said modulation comprises the step of providing a portion of variable geometry (2'b, 7, 14) on only one of the die (5', 5", 5'") and blank holder (2', 2", 2'").

5. Process according to claim 1, comprising the further step of modulating a counter-pressure prevailing in the cavity (3') with the help of a fluid under pressure.

6. Device for controlling play between a die and a blank holder during stamping, comprising:

a matrix (4') with a cavity (3') adapted to receive a die (5', 5", 5'") for stamping a metallic blank (1);

a blank holder for fixing the blank on the matrix; and modifying means (2'b, 7, 14) to modify the play between the die and the blank holder in the course of the stamping operation.

7. Device according to claim 6, wherein said modifying means comprise:

a first movable portion (2'b) of the blank holder (2') movable by a moving means (6) for approaching and receding from the die (5'); and a second portion (1*c*) of the blank (1) being adapted to bear against said first movable portion (2'b) of the blank holder during stamping.

8. Device according to claim 7, wherein said moving means (6) is controlled by movement of the die (5').

9. Device according to claim 6, wherein said modifying means comprise a set of retractable cams (7) articulated on the die (5") with movement controlled as a function of movement of said die, said cams constituting a bearing and shaping surface for the blank (1).

10. Device according to claim 9, wherein the cams (7) are controlled by a slide (9) driven simultaneously with the die (5"), the slide movement controlled by sliding on an inclined surface (11) of the blank holder (2").

11. Device according to claim 6, wherein said modifying means comprise a retractable bladder (14) disposed in the die (5'") and connected to a source of adjustable fluid pressure, said bladder constituting a bearing and forming surface for the blank (1).

12. Device according to claim 11, wherein the pressure of the fluid of said source is subject to the movement of the die (5''').

13. Process for hydroforming sheet metal, comprising the steps of:

fixing with the help of a blank holder (2', 2'', 2''') a blank (1) to a matrix (4') provided with a cavity (3') for stamping said blank (1) with a die (5', 5'', 5''') penetrating the matrix; and keeping the play between the die (5', 5'', 5''') and the blank holder (2', 2'', 2''') within a range of values preventing the formation of a fold between said die and matrix, as a function of a position of the die (5', 5'', 5''') relative to the matrix during stamping.

14. Process according to claim 13, wherein the keeping the play between the die (5', 5'', 5''') and the blank holder (2', 2'', 2''') step is effected by modulation of the geometry of facing portions of said die and blank holder during stamping.

15. Process according to claim 13, wherein said modulation is carried out during an initial stamping phase and is followed by the establishment of a permanent minimum play (j).

16. Process according to claim 13, wherein said modulation comprises the step of providing a portion of variable geometry (2'b, 7, 14) on only one of the die (5', 5'', 5''') and blank holder (2', 2'', 2''').

* * * * *